US005803438A

United States Patent [19]

Blouin

[11] Patent Number: 5,803,438

[45] Date of Patent: Sep. 8, 1998

[54] PLASTIC FENCING

[76] Inventor: David A. Blouin, 75 Oak Ridge Rd., Weare, N.H. 03281

[21] Appl. No.: 839,961

[22] Filed: Apr. 24, 1997

[51] Int. Cl.[6] ..... E04H 17/14

[52] U.S. Cl. ..... 256/66; 256/65; 256/59

[58] Field of Search ..... 256/24, 66, 65, 256/67, 59, 19, 73, 34, 22

[56] References Cited

U.S. PATENT DOCUMENTS

| | | | |
|---|---|---|---|
| 286,182 | 10/1883 | Cunningham et al. | 256/24 X |
| 3,973,756 | 8/1976 | Lauzier | 256/65 X |
| 4,074,893 | 2/1978 | Coltrin | 256/65 X |
| 4,361,314 | 11/1982 | Ohlson | 256/66 X |
| 4,477,058 | 10/1984 | Lowery | 256/19 |
| 4,684,108 | 8/1987 | Bergagnini | 256/24 |
| 4,702,459 | 10/1987 | Moschner | 256/19 |
| 4,735,397 | 4/1988 | Degagne | 256/65 |
| 4,898,365 | 2/1990 | Conner et al. | 256/22 X |
| 5,215,290 | 6/1993 | Khalessi | 256/19 |
| 5,255,897 | 10/1993 | Pepper | 256/24 |
| 5,551,194 | 9/1996 | Toomey | 256/65 X |
| 5,601,278 | 2/1997 | Graber | 256/66 |
| 5,645,270 | 7/1997 | Lawrence | 256/66 |

*Primary Examiner*—Brian K. Green
*Assistant Examiner*—William L. Miller

[57] ABSTRACT

A new Plastic Fencing for providing an easily installable modular fence system. The inventive device includes at least one corner post having at least one pair of corner post recesses formed therein, at least one intermediate post having at least one pair of intermediate post recesses formed therein, at least one end post having at least one end post recess formed therein, and a plurality of rails for horizontally spanning a plurality of distances between the corner posts, intermediate posts and end posts, the rails being removably attachable to the corner post recesses, intermediate post recesses and end post recesses. A picket fence system is also provided having picket slats removably attachable to picket rails.

18 Claims, 4 Drawing Sheets

PLASTIC FENCING

BACKGROUND OF THE INVENTION

1. Field of the Invention

The present invention relates to modular fence systems and more particularly pertains to a new Plastic Fencing for providing an easily installable modular fence system.

2. Description of the Prior Art

The use of modular fence systems is known in the prior art. More specifically, modular fence systems heretofore devised and utilized are known to consist basically of familiar, expected and obvious structural configurations, notwithstanding the myriad of designs encompassed by the crowded prior art which have been developed for the fulfillment of countless objectives and requirements.

Known prior art modular fence systems include U.S. Pat. No. 5,215,290; U.S. Pat. No. 5,255,897; U.S. Pat. No. 4,684,108; U.S. Pat. No. 4,702,459; and U.S. Pat. No. 4,477,058.

While these devices fulfill their respective, particular objectives and requirements, the aforementioned patents do not disclose a new Plastic Fencing. The inventive device includes at least one corner post having at least one pair of corner post recesses formed therein, at least one intermediate post having at least one pair of intermediate post recesses formed therein, at least one end post having at least one end post recess formed therein, a plurality of rails for horizontally spanning distances between the corner posts, intermediate posts and end posts and means for removably attaching the rails to the corner post recesses, intermediate post recesses and end post recesses.

In these respects, the Plastic Fencing according to the present invention substantially departs from the conventional concepts and designs of the prior art, and in so doing provides an apparatus primarily developed for the purpose of providing an easily installable modular fence system.

SUMMARY OF THE INVENTION

In view of the foregoing disadvantages inherent in the known types of modular fence systems now present in the prior art, the present invention provides a new Plastic Fencing construction wherein the same can be utilized for providing an easily installable modular fence system.

The general purpose of the present invention, which will be described subsequently in greater detail, is to provide a new Plastic Fencing apparatus and method which has many of the advantages of the modular fence systems mentioned heretofore and many novel features that result in a new Plastic Fencing which is not anticipated, rendered obvious, suggested, or even implied by any of the prior art modular fence systems, either alone or in any combination thereof.

To attain this, the present invention generally comprises at least one corner post having at least one pair of corner post recesses formed therein, at least one intermediate post having at least one pair of intermediate post recesses formed therein, at least one end post having at least one end post recess formed therein, a plurality of rails for horizontally spanning distances between the corner posts, intermediate posts and end posts and means for removably attaching the rails to the corner post recesses, intermediate post recesses and end post recesses.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new Plastic Fencing apparatus and method which has many of the advantages of the modular fence systems mentioned heretofore and many novel features that result in a new Plastic Fencing which is not anticipated, rendered obvious, suggested, or even implied by any of the prior art modular fence systems, either alone or in any combination thereof.

It is another object of the present invention to provide a new Plastic Fencing which may be easily and efficiently manufactured and marketed.

It is a further object of the present invention to provide a new Plastic Fencing which is of a durable and reliable construction.

An even further object of the present invention is to provide a new Plastic Fencing which is susceptible of a low cost of manufacture with regard to both materials and labor, and which accordingly is then susceptible of low prices of sale to the consuming public, thereby making such Plastic Fencing economically available to the buying public.

Still yet another object of the present invention is to provide a new Plastic Fencing which provides in the apparatuses and methods of the prior art some of the advantages thereof, while simultaneously overcoming some of the disadvantages normally associated therewith.

Still another object of the present invention is to provide a new Plastic Fencing for providing an easily installable modular fence system.

Yet another object of the present invention is to provide a new Plastic Fencing which includes at least one corner post having at least one pair of corner post recesses formed therein, at least one intermediate post having at least one pair of intermediate post recesses formed therein, at least one end post having at least one end post recess formed therein, a plurality of rails for horizontally spanning distances between the corner posts, intermediate posts and end posts and means for removably attaching the rails to the corner post recesses, intermediate post recesses and end post recesses.

Still yet another object of the present invention is to provide a new Plastic Fencing that is recyclable.

Even still another object of the present invention is to provide a new Plastic Fencing that is maintenance free.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
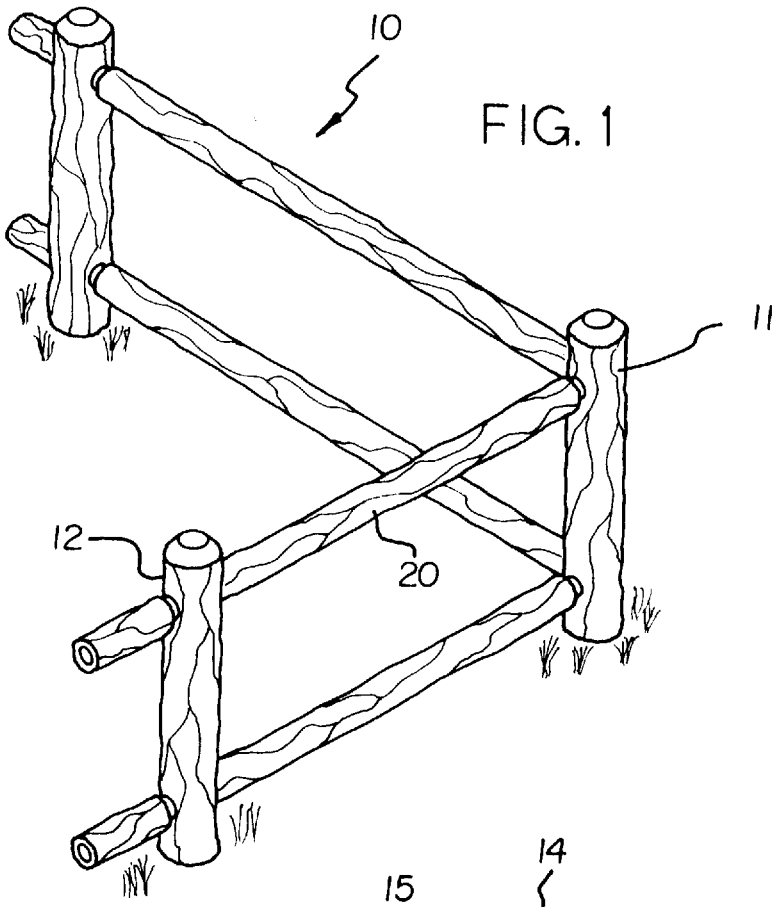
FIG. 1 is a perspective view of a new Plastic Fencing according to the present invention.

With reference now to the drawings, and in particular to FIGS. 1 through 7 thereof, a new Plastic Fencing embodying the principles and concepts of the present invention and generally designated by the reference numeral 10 will be described.

More specifically, it will be noted that the Plastic Fencing 10 comprises at least one corner post 11, at least one intermediate post 12, at least one end post 13, a plurality of rails 20 for horizontally spanning a plurality of distances between the corner posts 11, intermediate posts 12 and end posts 13 and a means for removably attaching the rails 20 to the corner posts 11, intermediate posts 12 and end posts 13. An alternative embodiment of the present invention provides for a plurality of picket slats 33 removably attachable to picket rails 32. All of the components of the Plastic Fencing 10 are fabricated from plastic and may be hollow.

With reference to FIG. 1 the Plastic Fencing 10 of the present invention is shown assembled including a corner post 11, two intermediate posts 12 and rails 20 for spanning the distance between each intermediate post 12 and the corner post 11. Recesses formed in the corner post 11 for removably attaching the rails 20 are shown disposed orthogonally from each other.

Figure 2:
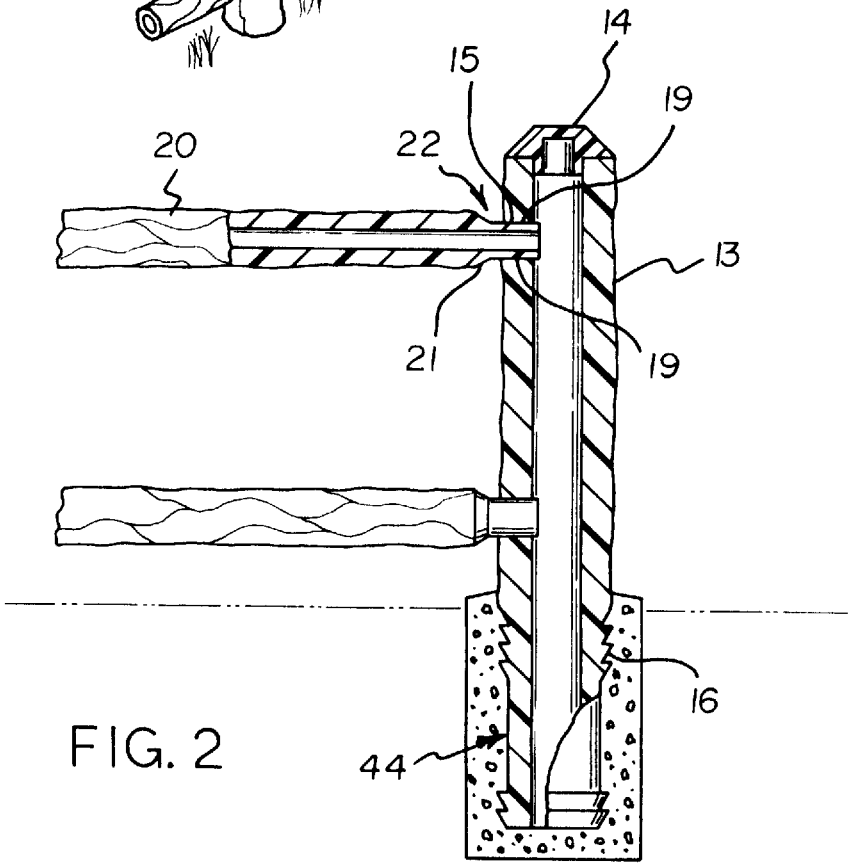
FIG. 2 is a partial cross sectional view showing an end post and rails connected thereto.

With reference to FIG. 2 an end post 13 is shown including two spaced apart end post recesses 15. Each rail 20 includes a rail end section 22 having a tapered section 21 and a narrow section 19. The narrow section 19 is frictionally receivable in the end post recess 15. While not shown in the Figures, the rails 20 are removably attachable to corner posts 11 and intermediate posts 12 in the same manner. The corner posts 11 and intermediate posts 12 include corner post recesses and intermediate post recesses respectively for frictionally receiving the narrow sections 19 of the rails 20.

Figure 5:
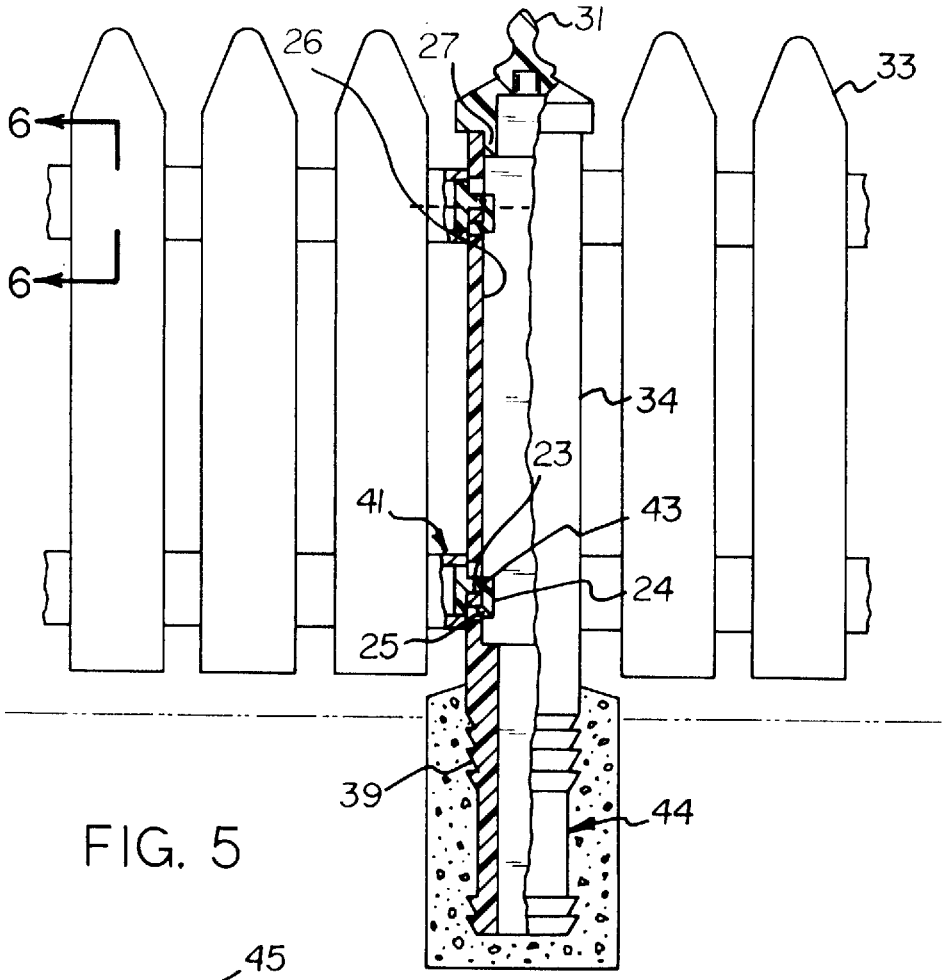
FIG. 5 is a partial cross sectional view thereof.

With continued reference to FIG. 2, the end post 13 is shown including a bottom section 44 having a means for anchoring 16 the end post into the ground. The means for anchoring 16 is shown in FIG. 5 including a plurality of spaced apart ribs 39. The corner posts 11 and intermediate posts 12 are anchored in the same fashion.

Figure 3:
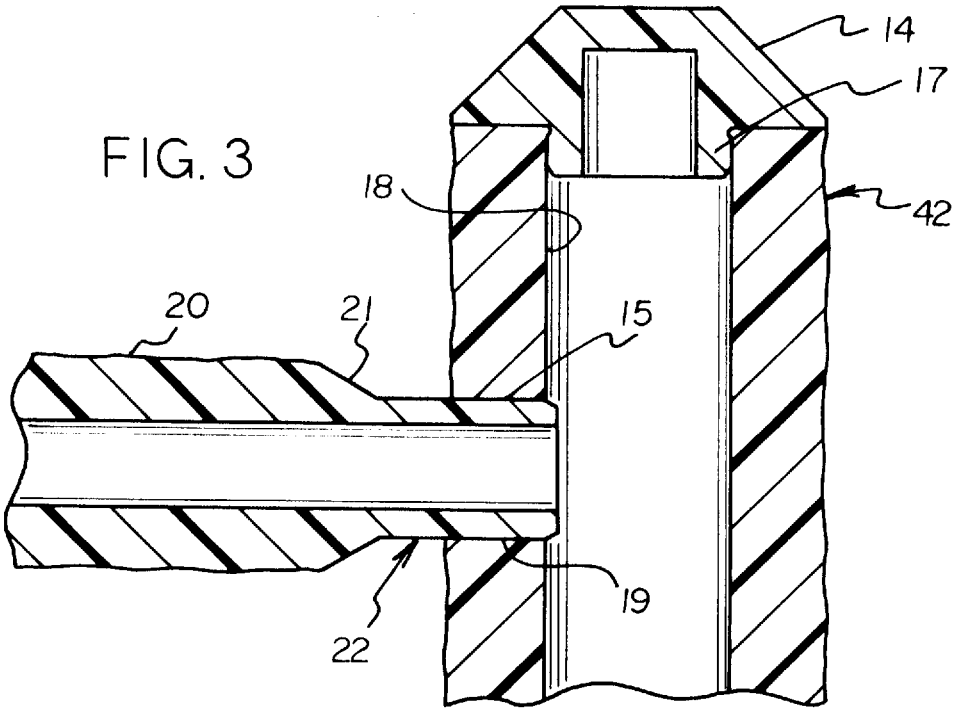
FIG. 3 is a cross sectional view of an end post and rail connection.

FIG. 3 shows the top section 42 of the end post 13. Shown are a cap 14 having an attachment plug 17 formed thereon for insertion into the hollow interior 18 of the top portion 42 of the end post for frictional attachment to the post 13. The attachment plug 17 provides additional frictional engagement to secure the cap 14 to the top portion 42. This design enables the attachment of caps of various shapes to be attached to the end post 13. Although not shown, caps are similarly attachable to the corner posts 11 and intermediate posts 12.

Figure 4:
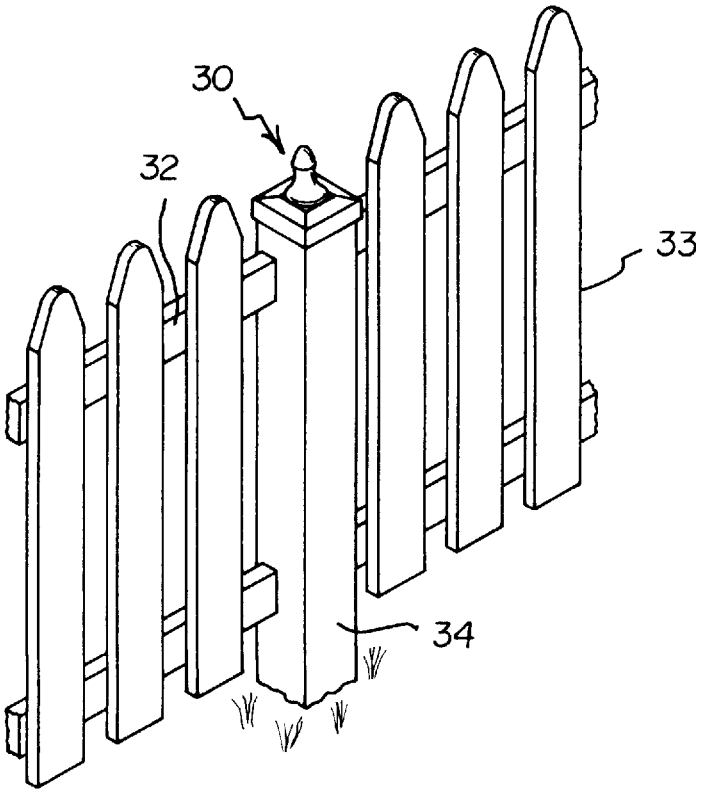
FIG. 4 is a perspective view of an alternative embodiment of the present invention.

With reference to FIG. 4 an alternative embodiment 30 of the present invention is shown. The picket rails 32 are rectangular in shape and are removably attachable to a rectangular intermediate picket post 34. Also shown are a plurality of rectangular picket slats 33. Not shown are the corresponding corner picket posts and end picket posts.

With reference to FIG. 5 the means for removably attaching the picket rails 32 to the picket posts is shown including a rectangular post rail engaging member 23 formed in an intermediate picket post recess. Picket rail end section 41 includes a post engaging member 24 integrally formed thereon. The post engaging member 24 depends perpendicular to a horizontal axis of the picket rail 32 and includes a protruding post rail engaging member engaging edge 25 which engages the post rail engaging member 23. The post engaging member 24 is pivotable, and thereby disengageable from the post rail engaging member 23, about a post engaging member channel 43 formed in the post engaging member 24 in a direction substantially parallel to the horizontal axis.

Also shown in FIG. 5 is a hollow picket cap 31 having a attachment plug 27 formed thereon for insertion into the hollow interior 26 for frictionally attaching the cap 31 to the top end of the picket post 34.

Figure 6:
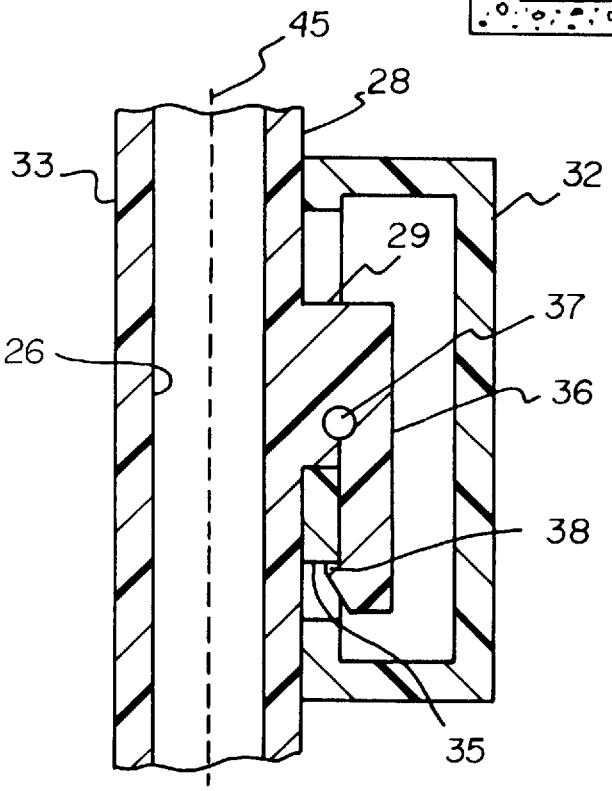
FIG. 6 is a cross sectional view taken along line 6—6 of FIG. 5.

With reference to FIG. 6 the means for removably attaching the picket slats 33 to the picket rails 32 is shown including a rail engaging member 36 integrally formed on a picket slat protrusion 29 integrally formed on a picket slat rear surface 28. The rail engaging member 36 includes a protruding edge 38 for engaging a slat engaging member 35 formed in a recess of the picket slat 32. The rail engaging member 36 is pivotable, and thereby disengageable from the slat engaging member 35, about a rail engaging member channel 37 formed in the rail engaging member 36 in a direction substantially perpendicular to a longitudinal axis 45 of the picket slat 33.

Figure 7:
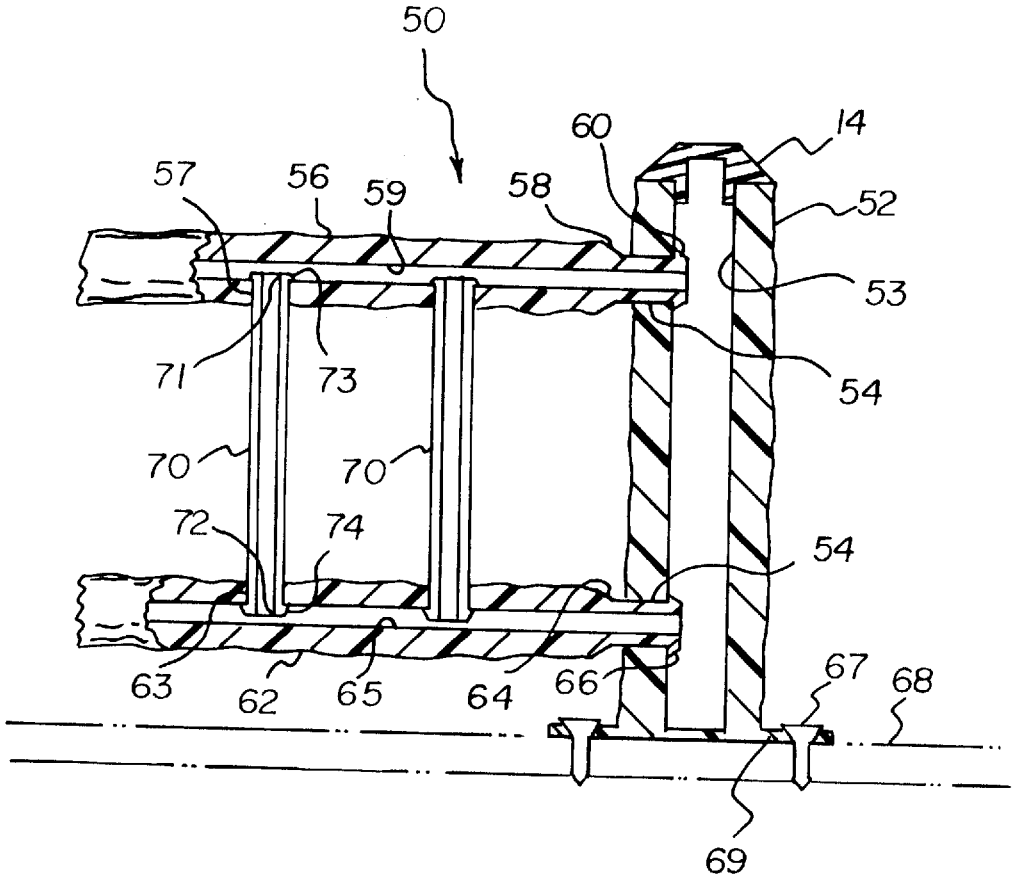
FIG. 7 is a cross sectional view of an optional embodiment of the present invention having rail spindles attached to a deck platform.

FIG. 7 depicts an optional embodiment of the present embodiment. This embodiment 50 shows an alternative method of attaching the components of the invention to each other. As with the other embodiments, the posts 52 have a plurality of rail recesses or holes 54. Each of the rails 56,62 each have tapered insertion section 58, 64 at each of their opposing ends (only one end shown). Extending outwardly from each insertion section is at least one attachment flange 60, 66. The attachment flanges 60,66 can be separate protrusions or form a single ring around the exterior surface of the tapered insertion sections 58,64. The attachment flanges 60,66 attach the rails 56,62 to the post 52 when the tapered sections 58, 58 are inserted into the rail recesses 54 so that the attachment flanges 60,66 expand when they reach the hollow interior 53 of the post 52. This permits some movement of the rails 56,62 to allow adjustment of their positioning but secures them in the post 52.

This optional embodiment 50 also shows an alternative to inserting the plastic fencing 10 into the ground. All of the embodiment of the plastic fencing 10 can be manufactured to be attached to a surface by means of a fastener 67. This alternative permits shows an example of this by attaching the post 52 to a deck 68 by commonly used fastening devices such as screws 67 to secure the base mounting bracket 69 of the post 52 to the deck 68.

This embodiment 50 of the invention also includes rail spindles 70 between the rails 56,62. In this embodiment, the rails each have a plurality of similarly aligned spindle sockets 57,63. The spindle sockets 57,63 are aligned in a substantially straight line along the length of their respective rail 56,62. Preferably, when the rails 56,62 are inserted into the post rail recess 54 the spindle sockets 57,63 of each rail 56,62 are similarly aligned so that each spindle socket 57 of one rail 56 face a corresponding spindle socket 63 in the other rail 62.

Each of the spindle 70 in this embodiment has a pair of opposing ends 71,72 that each has at least one attachment flange 73,74. The ends 71,72 are inserted into their respective spindle socket 57,63 so that the flanges 73,74 extend into the hollow interiors 59,65 so that they secure the spindles 70 to the rails 56,62.

In use, the Plastic Fencing 10 is assembled by first selecting anchoring positions for the corner posts 11, intermediate posts 12 and end posts 13. By sequentially anchoring neighboring posts into the ground and attaching the rails 20 or picket rails 32 between neighboring posts, an area can be fenced. If picket rails 32 have been used, picket slats 33 are attached to the picket rails 32 to complete the modular fence system. Damaged picket slats 33 are easily removed from the picket rails 32 by merely exerting a force upon the picket slat 33 in a direction away from the picket rail 32 and lifting the picket slat 33 from the slat engaging member 35. Other components of the Plastic Fencing 10 are similarly easily replaceable.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A plastic fencing comprising:

at least one corner post having at least one pair of corner post recesses formed therein;

at least one intermediate post having at least one pair of intermediate post recesses formed therein;

at least one end post having at least one end post recess formed therein;

a plurality of rails for horizontally spanning a plurality of distances between the corner posts, intermediate posts and end posts;

means for removably attaching the rails to the corner post recesses, intermediate post recesses and end post recesses; and wherein the means for removably attaching the rails to the corner post recesses, intermediate post recesses and end post recesses further comprise a post rail engaging member formed in the corner post recesses, intermediate post recesses and end post recesses, and a post engaging member integrally formed on each of a pair of rail end sections disposed on opposite ends of each said rail, the post engaging member being disposed perpendicular to a horizontal axis of the rail, the post engaging member having a protruding edge disposed substantially horizontally from the post engaging member, the protruding edge being for detachably engaging the post rail engaging member and being pivotable in a direction substantially parallel to the horizontal axis about a post engaging member channel formed in the post engaging member.

2. The plastic fencing of claim 1, wherein each said corner post, intermediate post and end post is hollow.

3. The plastic fencing of claim 1, wherein each said corner post, intermediate post and end post further comprises a top section having a hollow interior.

4. The plastic fencing of claim 3, wherein each said corner post, intermediate post and end post further comprises a cap removably insertable into said hollow interior of said post top section.

5. The plastic fencing of claim 1, wherein each said corner post, intermediate post and end post further comprises a bottom section having integrally disposed thereon a means for anchoring each said corner post, intermediate post and end post into the ground.

6. The plastic fencing of claim 1, further comprising a plurality of picket slats, the picket slats being removably attachable to the rails.

7. The plastic fencing of claim 1, wherein the corner post recesses are disposed orthogonally from each other.

8. The plastic fencing of claim 6, wherein the corner posts, intermediate posts, end posts, picket slats and rails have a rectangular shape.

9. A plastic fencing comprising:

at least one corner post having at least one pair of corner post recesses formed therein:

at least one intermediate post having at least one pair of intermediate post recesses formed therein:

at least one end post having at least one end post recess formed therein;

a plurality of rails for horizontally spanning a plurality of distances between the corner posts, intermediate posts and end posts;

means for removably attaching the rails to the corner post recesses, intermediate post recesses and end post recesses;

a plurality of picket slats, the picket slats being removably attachable to the rails; and wherein the picket slats further comprise a longitudinal axis, a rear surface and at least one rail engaging member depending downwardly and parallel to the longitudinal axis from a picket slat protrusion formed integrally on the rear surface, the rail engaging member having a protruding edge for detachably engaging a slat engaging member formed on the rail and being pivotable in a direction substantially perpendicular to the longitudinal axis about a rail engaging member channel formed in the rail engaging member.

10. The plastic fencing of claim 9, wherein the means for removably attaching the rails to the corner post recesses, intermediate post recesses and end post recesses further comprise a post rail engaging member formed in the corner post recesses, intermediate post recesses and end post recesses, and a post engaging member integrally formed on each of a pair of rail end sections disposed on opposite ends of each said rail, the post engaging member being disposed perpendicular to a horizontal axis of the rail, and having a protruding post rail engaging member engaging edge for detachably engaging the post rail engaging member and being pivotable in a direction substantially parallel to the horizontal axis about a post engaging member channel formed in the post engaging member.

11. The plastic fencing of claim 9, wherein the means for removably attaching the rails to the corner post recesses, intermediate post recesses and end post recesses further comprise a pair of rail end sections disposed on opposite ends of each said rail, the rail end sections having a tapered section terminating in a narrow section, the narrow section being frictionally attachable to the corner post recesses, intermediate post recesses and end post recesses.

12. The plastic fencing of claim 9, wherein each said corner post, intermediate post and end post is hollow.

13. The plastic fencing of claim 9, wherein each said corner post, intermediate post and end post further comprises a top section having a hollow interior.

14. The plastic fencing of claim 13, wherein each said corner post, intermediate post and end post further comprises a cap removably insertable into said hollow interior of said post top section.

15. The plastic fencing of claim 9, wherein each said corner post, intermediate post and end post further comprises a bottom section having intergrally disposed thereon a means for anchoring each said corner post, intermediate post and end post into the ground.

16. The plastic fencing of claim 9, wherein the corner post recesses are disposed orthogonally from each other.

17. The plastic fencing of claim 9, wherein the corner posts, intermediate posts, end posts, picket slats and rails have a rectangular shape.

18. A plastic fencing comprising:

at least one corner post having at least one pair of corner post recesses formed therein, the corner post recesses being disposed orthogonally from each other;

at least one intermediate post having at least one pair of intermediate post recesses formed therein;

at least one end post having at least one end post recess formed therein;

a plurality of rails for horizontally spanning a plurality of distances between the corner posts, intermediate posts and end posts;

a plurality of rectangularly shaped picket slats, the picket slats being removably attachable to the rails;

wherein each said rail further comprises at least one slat engaging member formed thereon;

wherein each said picket slat further comprises a longitudinal axis, a rear surface and at least one rail engaging member depending downwardly and parallel to the longitudinal axis from a picket slat protrusion formed integrally on the rear surface, the rail engaging member having a protruding edge for detachably engaging the slat engaging member and being pivotable in a direction substantially perpendicular to the longitudinal axis about a rail engaging member channel formed in the rail engaging member;

wherein each said corner post recess, intermediate post recess and end post recess further comprises a post rail engaging member formed therein;

wherein each said rail further comprises a pair of rail end sections, the rail end sections having a post engaging member integrally formed thereon, the post engaging member being disposed perpendicular to a horizontal axis of the rail and having a protruding post rail engaging member engaging edge for detachably engaging the post rail engaging member and being pivotable in a direction substantially parallel to the horizontal axis about a post engaging member channel formed in the post engaging member;

wherein the corner posts, intermediate posts, end posts and rails have a rectangular shape;

wherein each said corner post, intermediate post and end post further comprises a bottom section, each said bottom section having a plurality of ribs formed thereon for anchoring each said corner post, intermediate post and end post into the ground; and wherein each said corner post, intermediate post and end post further comprises a top section having a hollow interior, said hollow interior formed to receive a cap.

* * * * *